US006202386B1

(12) United States Patent
Jones et al.

(10) Patent No.: US 6,202,386 B1
(45) Date of Patent: Mar. 20, 2001

(54) METHOD FOR COLOR IDENTIFICATION OF COSMETIC PRODUCTS

(76) Inventors: Bettina M. Jones; Mark C. Jones, both of 4107 Luckenbach, San Antonio, TX (US) 78251

( * ) Notice: Subject to any disclaimer, the term of this patent is extended or adjusted under 35 U.S.C. 154(b) by 0 days.

(21) Appl. No.: 09/466,613

(22) Filed: Dec. 17, 1999

Related U.S. Application Data

(62) Division of application No. 09/343,355, filed on Jun. 30, 1999.

(51) Int. Cl.[7] ..... B65B 61/00

(52) U.S. Cl. ..... 53/410; 206/823; 206/581; 53/484; 53/476

(58) Field of Search ..... 53/410, 473, 476, 53/484; 206/581, 823, 81, 293, 303, 730, 732; 40/219, 124.06

(56) References Cited

U.S. PATENT DOCUMENTS

| | | | | |
|---|---|---|---|---|
| 3,911,936 | | 10/1975 | Kingsford | 132/79 |
| 4,373,632 | * | 2/1983 | VanZandt | 206/81 |
| 4,469,226 | | 9/1984 | Matney | 206/470 |
| 4,815,608 | | 3/1989 | Silberberg | 132/295 |
| 4,884,680 | * | 12/1989 | Israel et al. | 206/823 |
| 4,903,838 | * | 2/1990 | Broers et al. | 206/823 |
| 5,150,791 | * | 9/1992 | Kamen et al. | 206/823 |
| 5,325,961 | | 7/1994 | Ford et al. | 206/229 |
| 5,735,297 | * | 4/1998 | Litton | 206/581 |
| 5,879,769 | | 3/1999 | Greenland et al. | 428/35.7 |

* cited by examiner

*Primary Examiner*—Peter Vo
*Assistant Examiner*—Louis Huynh
(74) *Attorney, Agent, or Firm*—Wayne J. Colton, Inc.

(57) ABSTRACT

A color identifier for use with a contained cosmetic product comprises a cosmetic grade foam swab for retaining a portion of the cosmetic product and a body for associating the swab with the cosmetic product. The body generally comprises a base for supporting the swab in a region adjacent the cosmetic product's container. Further, the body comprises a translucent enclosure, through which the swab is viewable, for maintaining the swab in place upon the base. A patch of adhesive is utilized for fixed application of the color identifier's body to the cosmetic product's container. In use, a portion of the cosmetic product is applied to the swab, which is then enclosed within the body. Because the body is provided with a translucent area, the portion of the cosmetic product applied to the swab is viewable notwithstanding its sealed enclosure within the body. The body is then fixedly associated with the cosmetic product's container, whereafter the color of the contained cosmetic product may be ascertained without need for opening of the container.

6 Claims, 1 Drawing Sheet

METHOD FOR COLOR IDENTIFICATION OF COSMETIC PRODUCTS

RELATED APPLICATIONS

This application claims, as a divisional application, priority under 35 USC §120 to co-pending U.S. patent application Ser. No. 09/343,355 filed Jun. 30, 1999. By this reference, the full disclosure, including the claims and drawings, of U.S. patent application Ser. No. 09/343,355 is incorporated herein as though now set forth in its entirety.

FIELD OF THE INVENTION

The present invention relates to cosmetic products. More particularly, the invention relates to a method and apparatus for ascertaining the color of a contained cosmetic product without need for opening of the product's container.

BACKGROUND OF THE INVENTION

The use of cosmetic products has grown ever more popular as evidenced by the burgeoning of the industry into a billion dollar business. With this popularity has also come the increased difficulty of managing one's own personal stock of products. It is not uncommon for one person to have several hundred products on the shelf, the right color and shade for the right occasion. Unfortunately, having the right color and being able to find it are two distinct issues.

Although some products are packaged in a manner that makes color identification of the contained product easy, most are not. After all, dedication of space on the product's container for an aperture takes away from space that might otherwise bear the manufacturer's trademarks. As a result, a means for identification of the color of a contained cosmetic product that may be implemented after the product's sale is needed.

It is therefore a primary object of the present invention to improve upon the prior art by providing a method and apparatus whereby the color of a contained cosmetic product may be associated with the exterior of the product's packaging. It is a further object of the present invention to provide such a method and apparatus that is easy to use and inexpensive to manufacture.

SUMMARY OF THE INVENTION

In accordance with the foregoing objects, the present invention—a color identifier for use with a contained cosmetic product—generally comprises a cosmetic grade foam swab for retaining a portion of the cosmetic product and a body for associating the swab with the cosmetic product. The body generally comprises a base for supporting the swab in a region adjacent the cosmetic product's container. Further, the body comprises a translucent enclosure, through which the swab is viewable, for maintaining the swab in place upon the base.

In the preferred embodiment of the present invention, the base is provided—on the underside away from the swab—with a patch of adhesive. This patch is covered with a non-adhesive backing, which is removable for fixed application of the color identifier's body to the cosmetic product's container. In this manner, the color identifier is said to be associated with the container, through which association the color of the contained cosmetic product may be ascertained without necessity for opening of the container.

In at least one embodiment of the present invention, the body is constructed from a flexible material, such as plastic. In this embodiment, the body itself preferably forms a hinge structure between the enclosure portion and the base portion whereby the enclosure portion may be folded over and atop the base portion. In this as well as other embodiments, an area of adhesive is preferably predisposed about the peripheral region of the enclosure portion, the base portion or both. When, in the described embodiment, the enclosure is folded atop the base or, in other embodiments, the enclosure portion is otherwise mated with the base, the adhesive interposed therebetween serves to contain the swab. In this manner, the cosmetic product retained upon the swab is prevented from fading due to evaporation of its various contents.

According to the preferred embodiment of the present invention, the adhesive area is provided as an annulus about the periphery of the enclosure. Similarly, an annular-shaped non-adhesive backing is provided to preserve the adhesive characteristics of the annulus until such time as the present invention is placed in use. At that time, the non-adhesive backing is removed, and disposed of, and the adhesive annulus is utilized to adjoin the enclosure and the base, the swab being circumscribed by the annulus and thereby sealed within the body.

In use, a portion of the cosmetic product is applied to the swab, which is then enclosed within the body. Because the body is provided with a translucent area, the portion of the cosmetic product applied to the swab is viewable notwithstanding its sealed enclosure within the body. The body is then fixedly associated with the cosmetic product's container, whereafter the color of the contained cosmetic product may be ascertained without need for opening of the container.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
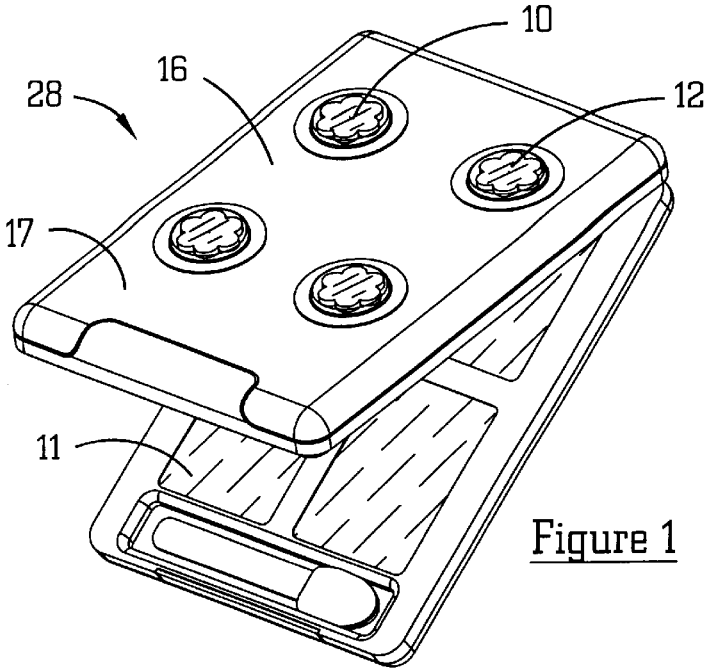
FIG. 1 shows, in perspective view, the color identifier of the present invention as placed in use upon a compact case.

Referring now to the various Figures and to FIG. 1 in particular, the present invention—a color identifier 10 for use with a contained cosmetic product 11—is shown to generally comprise a cosmetic grade foam swab 12 for retaining a portion 13 of the cosmetic product and a body 14 for associating the swab 12 with the cosmetic product 11. The body 14 generally comprises a base 15 for supporting the swab 12 in a region 16 adjacent the cosmetic product's container 17. Further, the body 14 comprises a translucent enclosure 18, through which the swab 12 is viewable, for maintaining the swab 12 in place upon the base 15.

Because, as will be more apparent upon a complete reading hereof, the swab 12 must hold a small sample portion 13 of the cosmetic product 11 for the usage life of the remainder of the cosmetic product 11, it is deemed critical to the present invention that the swab 12 be constructed from a material having the characteristics of a foam with very fine cellular structure—i.e., a foam not subject to over-absorption of the cosmetic sample 13. Applicant has found that one such suitable foam is that utilized in the cosmetics industry, generally in the form of a cosmetic wedge or round, for application of cosmetic products.

Figure 2:
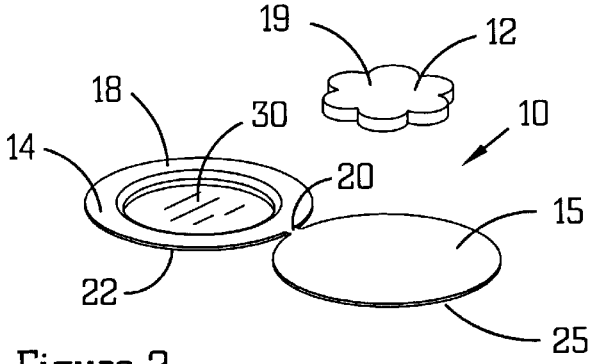
FIG. 2 shows, in perspective view, the color identifier of FIG. 1 in an early stage of the manufacturing process.

As is well-known to those of ordinary skill in the art, this type of polyurethane foam with hydrophilic properties is readily available from any of a variety of manufacturers such as, for example, Lendell Mfg., Inc. of St. Charles, Mich., which sells such a product under the trademark "NO LATEX." In addition to its ideal absorption and release characteristics, this type of foam is also easily cut to a desired shape, such as the flower shape 19 utilized in the preferred embodiment. Because, as also will be better understood further herein, the swab 12 must exhibit the sampled cosmetic product 13 in true color, it is highly desirable that the swab 12 be bright white in color. In any case, the swab 12 is permanently attached to the base 15 of the body 14 with hot glue, epoxy or any substantially equivalent adhesive, as shown in FIGS. 2 and 3.

Figure 4:
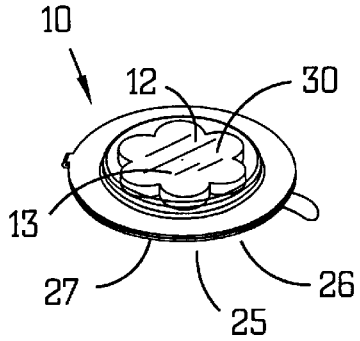
FIG. 4 shows, in perspective view, the color identifier of FIG. 1 as readied by the consumer for application to a cosmetic product's container.

In at least one embodiment of the present invention, the body 14 is constructed from a flexible material, such as plastic. One such suitable plastic is that which is well-known to those or ordinary skill in the art and readily available under the trademark "LEXAN." In any case, in the plastic embodiment the body 14 itself preferably forms a hinge structure 20, as particularly shown in FIG. 3, between the enclosure portion 18 and the base portion 15 whereby the enclosure portion 18 may be folded over and atop the base portion 15, as shown in FIG. 4. In this as well as other embodiments, an area 21 of adhesive is preferably predisposed about the peripheral region 22 of the enclosure portion 18, the base portion 15 or both. When, in the described embodiment, the enclosure 18 is folded atop the base 15 or, in other embodiments, the enclosure portion 18 is otherwise mated with the base 15, the adhesive 21 interposed therebetween serves to contain the swab 12. In this manner, the cosmetic product 13 retained upon the swab 12 is prevented from fading due to evaporation of its various contents.

Figure 3:
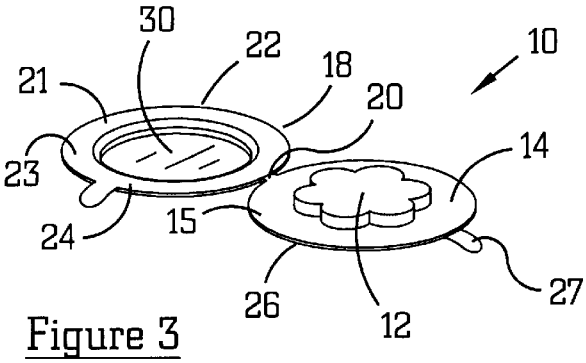
FIG. 3 shows, in perspective view, the color identifier of FIG. 1 as prepared for distribution to the consumer.

According to the preferred embodiment of the present invention, the adhesive area 21 is provided as an annulus 23 about the periphery 22 of the enclosure 18, as shown in FIG. 3. Similarly and as also shown in FIG. 3, an annular-shaped non-adhesive backing 24 is provided to preserve the adhesive characteristics of the annulus 23 until such time as the present invention 10 is placed in use. At that time, the non-adhesive backing 24 is removed, and disposed of, and the adhesive annulus 23 is utilized to adjoin the enclosure 18 and the base 15, the swab 12 being circumscribed by the annulus 23 and thereby sealed within the body 14, as detailed in FIG. 4.

In the preferred embodiment of the present invention 10, the base 14 is provided—on the underside 25 away from the swab 12—with a patch 26 of adhesive. This patch 26 is covered with a non-adhesive backing 27, which is removable for fixed application of the color identifier's body 14 to the cosmetic product's container 17, as shown with the compact case 28 of FIG. 1 or the lipstick container 29 of FIG. 5. In this manner, the color identifier 10 is said to be associated with the container 17, through which association the color of the contained cosmetic product 11 may be ascertained without necessity for opening of the container 17.

Figure 5:
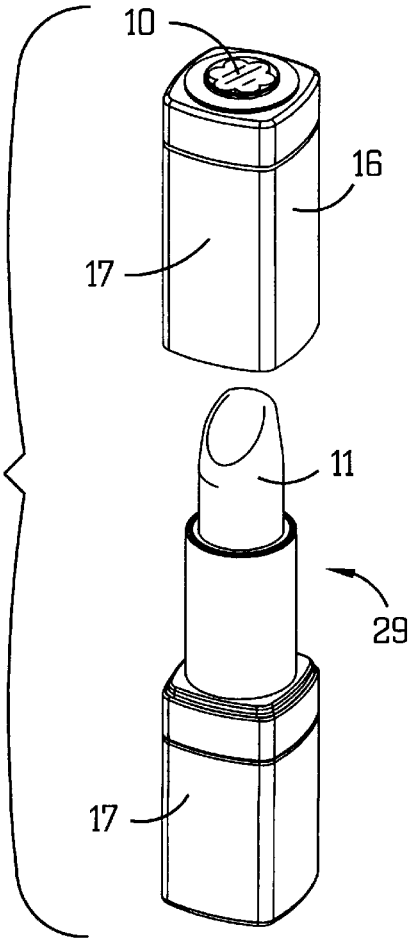
FIG. 5 shows, in perspective view, the color identifier of the present invention as applied to a lipstick container.

In use, the color identifier 10 is provided to the consumer as generally depicted in FIG. 3. The consumer then applies a portion 13 of the cosmetic product 11 to the swab 12. The non-adhesive backing 24 over the adhesive annulus 23 is then removed and the swab 12 enclosed within the body 14, as shown in FIG. 4. Because the body 14 is provided with a translucent area 30, the portion 13 of the cosmetic product 11 applied to the swab 12 is viewable notwithstanding its sealed enclosure within the body 14. Finally, the non-adhesive backing 27 over the adhesive patch 26 is removed and the body 14 is then fixedly associated with the cosmetic product's container 17, as shown in FIGS. 1 and 5, whereafter the color of the contained cosmetic product 11 may be ascertained without need for opening of the container 17.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, while the hinge feature 20 of the present invention provides the greatest convenience to the consumer, it is not critical to the use of the invention. In an alternative embodiment, the enclosure portion 18 of the body 14 and the base 15 portion may be provided separately to the consumer, becoming unitary only upon sealing of the swab 12 therebetween. In any case, because the scope of the present invention is much broader than any particular embodiment, the foregoing detailed description should not be construed as a limitation of the scope of the present invention, which is limited only by the claims appended hereto.

What is claimed is:

1. A method for color identification of a contained cosmetic product, said method comprising the steps of:

applying a portion of the cosmetic product to a swab;

providing a container containing the cosmetic product;

enclosing the swab having the applied portion of the cosmetic product in a body, said body having a translucent area through which said portion of the cosmetic product is viewable; and fixedly associating said body with the cosmetic product's container.

2. The method for color identification as recited in claim 1, wherein:

said body comprises a base and a top; and said enclosing step comprises securing said top to said base, said swab being thereby interposed between said top and said base.

3. The method for color identification as recited in claim 2, wherein said top is hingedly attached to said base.

4. The method for color identification as recited in claim 2, wherein:

said body further comprises an adhesive annulus, said adhesive annulus being adapted to circumscribe said swab; and said enclosing step further comprises adhering said top to said base through said adhesive annulus.

5. The method for color identification as recited in claim 4, wherein:

said base comprises an adhesive patch; and said fixedly associating step comprises bringing said adhesive patch into contact with the cosmetic product's container.

6. The method for color identification as recited in claim 2, wherein:

said base comprises an adhesive patch; and said fixedly associating step comprises bringing said adhesive patch into contact with the cosmetic product's container.

* * * * *